US005816771A

United States Patent [19]

Stevens

[11] Patent Number: 5,816,771

[45] Date of Patent: Oct. 6, 1998

[54] GRIPPER ARM ASSEMBLY

[75] Inventor: Kenneth A. Stevens, Glen Ellyn, Ill.

[73] Assignee: Electro-Mechancis Corporation, Batavia, Ill.

[21] Appl. No.: 733,396

[22] Filed: Oct. 18, 1996

Related U.S. Application Data

[63] Continuation of Ser. No. 401,184, Mar. 9, 1995, abandoned.

[51] Int. Cl.[6] ..... B66C 1/42

[52] U.S. Cl. ..... 414/729; 248/230.5; 403/390; 403/391

[58] Field of Search ..... 414/729, 740; 29/718; 198/468.2, 409; 271/85; 285/137.1; 403/389, 391, 396, 384, 390; 248/230.5, 230.1, 68.1

[56] References Cited

U.S. PATENT DOCUMENTS

| | | | |
|---|---|---|---|
| 3,604,687 | 9/1971 | Moore | 403/391 X |
| 4,422,348 | 12/1983 | Campbell | 403/344 X |
| 4,460,083 | 7/1984 | Oyama | 198/486 |
| 4,595,162 | 6/1986 | Matsumura et al. | 248/68.1 |
| 4,634,107 | 1/1987 | Vandersyde et al. | 271/85 X |
| 4,645,411 | 2/1987 | Madwed | 414/753 |
| 4,728,097 | 3/1988 | Vandersyde et al. | 271/263 X |
| 5,324,017 | 6/1994 | Bubley et al. | 271/85 |
| 5,377,939 | 1/1995 | Kirma | 248/68.1 |

*Primary Examiner*—Donald W. Underwood
*Attorney, Agent, or Firm*—Lee, Mann, Smith, McWilliams, Sweeney & Ohlson

[57] ABSTRACT

An improved gripping arm assembly including a two-piece gripper arm body construction which includes an arm clamp having alignment pins, and an arm main body with corresponding alignment holes for receiving the clamp pins, and a means for securably attaching the main body with the clamp. This two-piece gripper arm construction is simpler to remove than one-piece standard gripper arms. To replace a broken gripper arm with a new gripper arm only requires unscrewing fasteners holding the two-piece old gripper arm together allowing detachment of the broken gripper arm from the shaft, and clamping the two pieces of the new gripper arm together around the shafts and securing the screws and re-clipping an operating rod. The two-piece construction eliminates the need to remove a shaft from the machine or other gripper arms from the shaft when repairing or replacing one gripper arm or replacing or repairing a shaft having gripper arms mounted thereto.

1 Claim, 4 Drawing Sheets

22
12
28
30
26
26a
26b
14
24
50

GRIPPER ARM ASSEMBLY

This application is a continuation of application Ser. No. 08/401,184 filed Mar. 9, 1995, now abandoned.

TECHNICAL FIELD

This invention relates to a gripping apparatus for use as an industrial manipulator for gripping items, more particularly to an improvement of the gripping apparatus used in a machine which may be removed from one or more shafts mounted in the machine or without sliding the gripper apparatus off an end of the shafts or removing the shafts from the machine.

BACKGROUND OF THE INVENTION

Presently, there exist a number of machines that perform the function of inserting envelopes, manipulating garbage bags for packaging, and generally for transferring items on a machine from one location on the machine to other locations on the machine.

Many of the envelope inserting machines have the capacity for performing the functions of separating inserts from a stack, opening the envelopes, inserting mailing inserts inside the envelopes, putting pre-determined printed matter on the envelopes, and sealing the envelopes. Having a machine that can perform all these functions can be very beneficial to the user, especially for the user having a large capacity of mailings to be mailed.

However, one major disadvantage of using this type of machine is the time and expense used to repair and service the machines. Parts of the machines which require substantial time and cost to repair and service include gripper arms used to grip and move mailing inserts on the machine.

Normally, when an attached gripper arm on the machine needs to be removed for repair or replacement, the entire shaft or shafts to which the gripper arm is attached must be removed from the machine. The existing one piece design for a gripper arm body requires that both a swing shaft and an operating lever shaft be removed. Prior to removing the shafts, extensive time is required to prepare the shafts for removal. The gripper arm is fastened to the swing shaft by tapered pins and set screws. The tapered pins can only be removed from the back of the gripper arm. To move the pins, the drive must first be disconnected, and then the arms have to be pivoted upside down placing the small end of the tapered pins in position for the removal. The pins are individually removed with a punch device. Additionally, there is a bell crank mounted on the shaft that has two pins that must be removed, and the gripper arm also has a pin that must be removed. The pusher arm must be unclamped and removed. Set screws in collars mounted on the shafts, the gripper arm drive and gripper arms must be loosened. The operating shaft must be removed also. In order to remove the operating shaft, the positioning collar must be removed. The operating lever must be loosened and the operating rod unclipped. After completing these steps the operating shaft can be pulled out of the arms and machine. With the operating shaft removed, each gripper arm (up to six per machine) can be moved to the left or the right to deburr their set screw marks on the shaft. With all the set screw burrs removed, the shaft can be removed slowly to avoid gripper arm damage. Additionally, since all the gripper arms in an inserter machine are mounted on the same set of shafts, other gripper arms attached to the shafts must be removed in order to remove the one gripper arm in need of repair or replacement. Each gripper arm is usually attached to a shaft by one tapered pin, therefore, each tapered pin must be removed. Additionally, collar members attached to these shafts by set screws must be removed. In essence, a number of taper pins must be removed to remove each gripper arm from the shaft and each collar member from the shaft, all in order to just remove one gripper arm. Conversely, when placing a repaired or replacement gripper arm back on the shaft, the other gripper arms must be placed back on the shaft, and repositioned along with the replacement gripper arm on the shaft. Since, removal of a standard gripper arm requires readjustment of all the removed parts, the replacement process could well exceed 2 hours.

SUMMARY OF THE INVENTION

The present invention contemplates eliminating the aforementioned disadvantages of the gripping devices which are mounted on shafts.

It is, therefore, an object of the present invention to provide an improved gripper arm which provides for minimal need of time consuming and costly repair and replacement of gripper arms on a machine utilizing gripper arms mounted on shafts.

In order to accomplish the above described objects, there is provided in the present invention an improved gripping arm assembly having an two-piece gripper arm body comprised of a arm main body and an arm clamp, attachment means for attaching the two-piece gripper arm together and onto one or more shafts, a gripper jaw, a two-piece operating lever, and an operating rod. The two-piece gripper arm body and operating lever construction eliminates the need to remove a shaft from the machine or other gripper arms from the shaft when replacing a gripper arm or operating lever. Only a small number of screws need to be removed to separate the gripper arm into two detached pieces, therefore, greatly simplifying the removal of the complete gripper arm from the inserter machine. The whole process only takes a few minutes to complete. To replace a gripper arm mounted on a shaft requires clamping the two pieces of the gripper arm together around the shafts and securing the screws and re-clipping an operating rod. This replacement process only takes a few minutes as well.

DETAILED DESCRIPTION OF THE PREFERRED EMBODIMENT

Figure 1:
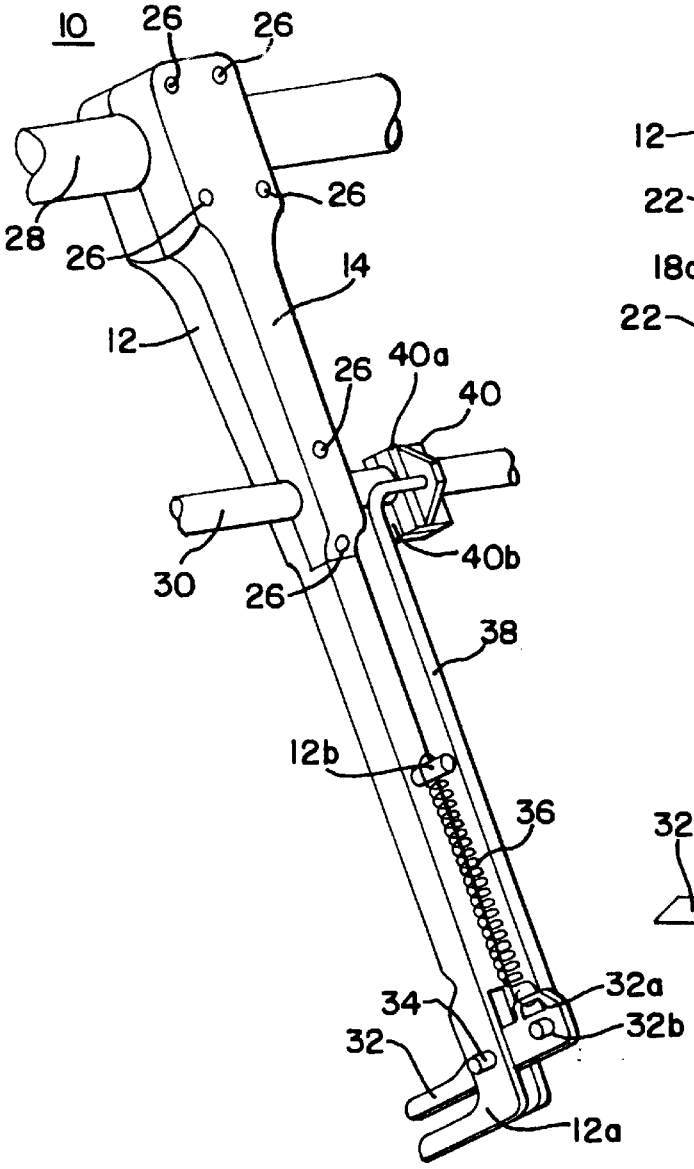
FIG. 1 is a perspective view of the gripper arm assembly mounted on a swing shaft and an operating lever shaft.

The principles of the invention are particularly useful when embodied in a gripper arm assembly as shown in FIG. 1, generally indicated by the numeral 10. In a preferred embodiment as better seen in FIG. 1, the gripper arm assembly 10 includes an elongated gripper arm main body 12 having a gripper portion 12*a* and an attachable arm clamp 14. Elements that work in conjunction with the arm main body 12 and clamp 14 to accomplish the task of grasping items, include a movable gripper jaw 32, a pivot pin 34 for the jaw 32, a return/tension spring 36, an operating rod 38 and an operating lever 40 for opening and closing the jaw 32.

Figure 2:
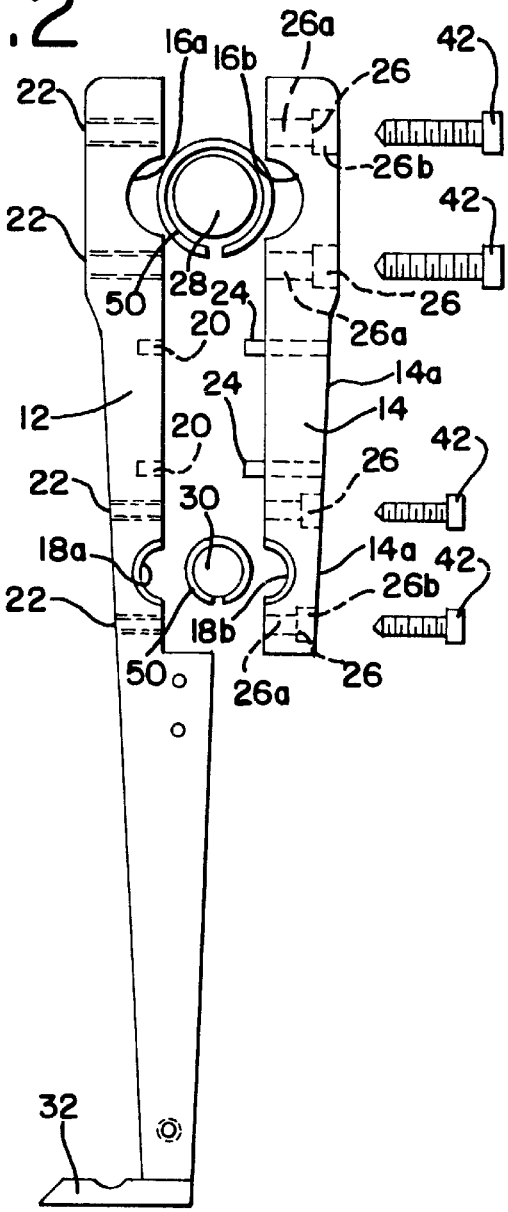
FIG. 2 is a side plan view of the arm main body portion separated from the arm clamp and also showing a cross-sectional view of the swing shaft and operating lever shaft.

As better seen in FIG. 2, the arm main body 12 has a swing shaft semi-circular cut-out section 16*a*, an operating lever shaft semi-circular cut-out section 18*a* therein, and a gripper portion 32. The arm main body 12 also has two alignment apertures 20. There are also four threaded bolt holes 22 extending through the main body 12. The arm clamp 14 has a corresponding swing shaft semi-circular cut-out section 16*b* and an operating lever shaft semi-circular cut-out section 18*b* therein. Extending from the arm clamp 14 are two extending alignment pins 24. On opposite sides of the swing shaft cut-out section 16*b* are bolt holes 26. Each bolt hole 26 has a narrow portion 26*a* for accommodating the passing of an elongated portion of a bolt 42 therethrough and a widened portion 26*b* for accommodating placement of the head of a bolt 42 below the outside surface 14*a* of the arm clamp 14.

Figure 2A:
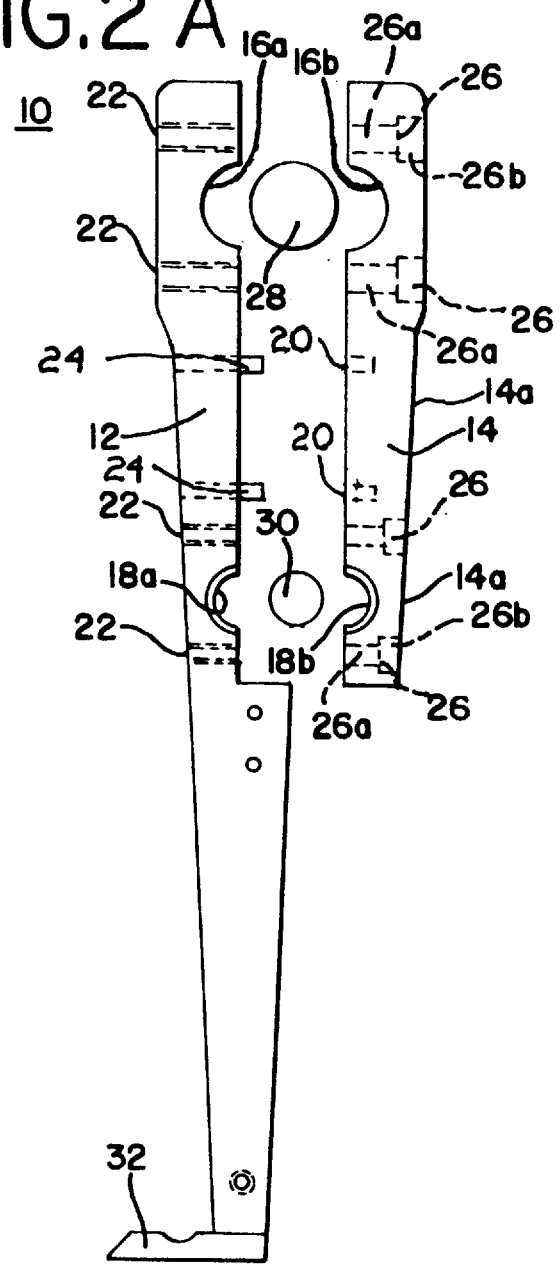
FIG. 2A is a side plan view of the arm main body portion having alignment pins connected thereto, separated from the arm clamp having pin receiving holes therein, and also showing a cross-sectional view of the swing shaft and operating lever shaft.
Figures 3, 4, 5, 6:
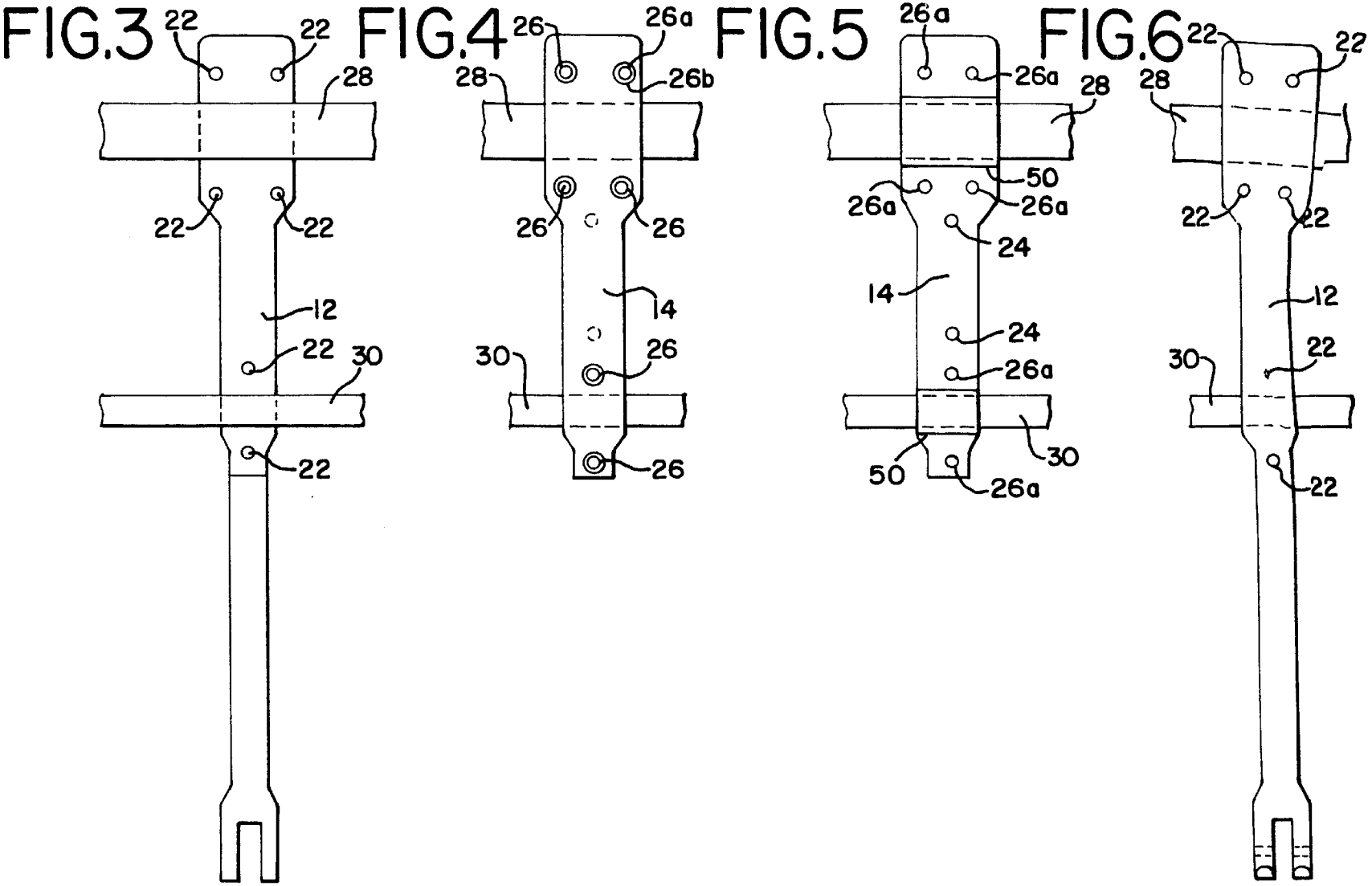
FIG. 3 is a rear plan view of the arm main body placed against a swing shaft and operating lever shaft.
FIG. 4 is a front plan view of the arm clamp placed against a swing shaft and operating lever shaft.
FIG. 5 is a rear plan view of the arm clamp placed against a swing shaft and an operating lever shaft.
FIG. 6 is a front plan view of the arm main body placed against a swing shaft and an operating lever shaft.
Figure 7:
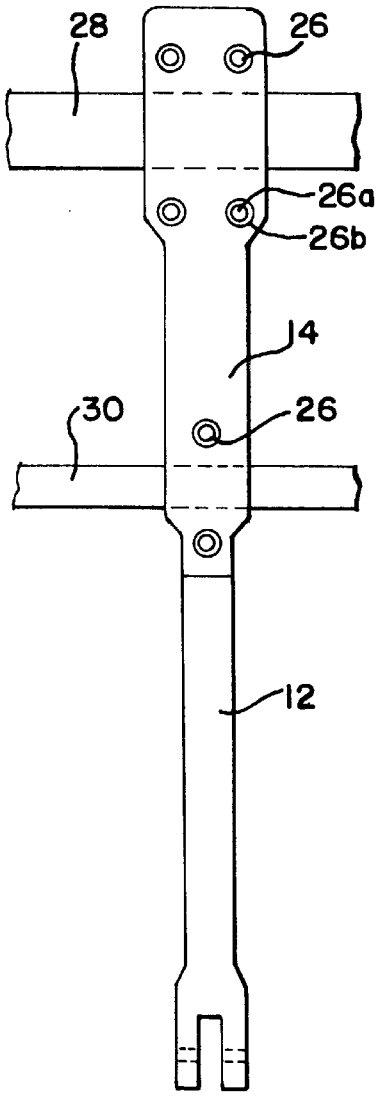
FIG. 7 is a rear plan view of the arm main body attached to the arm clamp portion with both portions mounted to the swing shaft and operating lever shaft.
Figure 8:
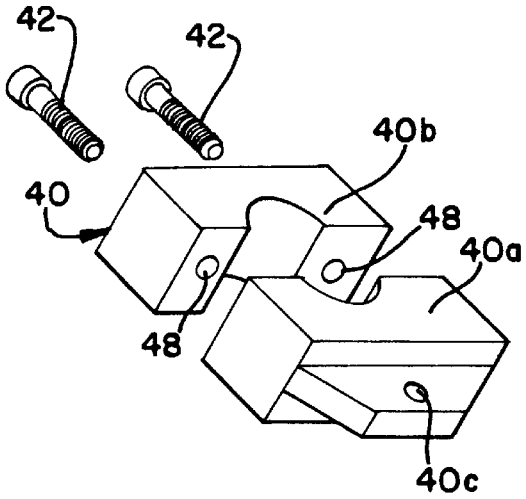
FIG. 8 is an exploded perspective view of the operating lever showing two connecting bolts.
Figure 9:
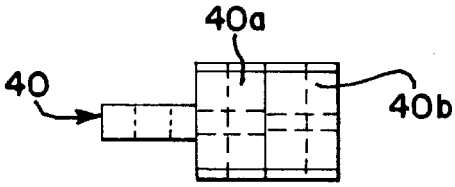
FIG. 9 is a top plan view of the operating lever.
Figure 10:
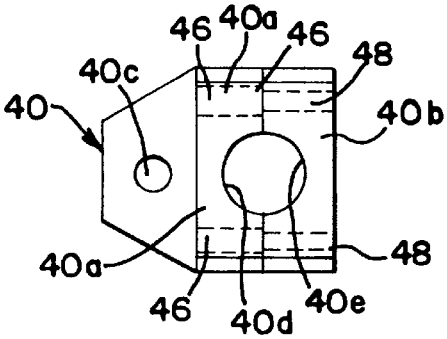
FIG. 10 is a side plan view of the operating lever.
Figure 11:
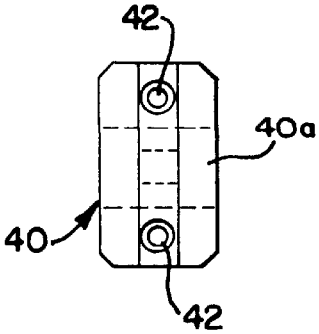
FIG. 11 is a front plan view of the operating lever.

The gripper arm main body 12 and clamp 14 are attached to a swing shaft 28 and an operating lever shaft 30 by placing the arm main body 12 against both shafts 28, 30 so that the swing shaft cut-out section 16*a* fits over approximately half the diameter of the swing shaft 28 and by placing the operating lever shaft cut-out section 18*a* over approximately half the diameter of the operating lever shaft 30. Next, the arm clamp 14 is placed against both shafts 28, 30 opposite the arm main body 12 so that the upper shaft cut-out section 16*b* fits over approximately half the diameter of the swing shaft 28 and is opposite upper shaft cut-out section 16*a*. A one-piece split nylon bushing 50 fits around shaft 28, between shaft 28 and cutout sections 16*a* and 16*b*. The operating lever shaft cut-out section 18*b* fits over approximately half the diameter of the operating lever shaft 30 and is opposite the operating lever shaft cut-out section 18*a*. A one-piece split nylon bushing 50 fits around shaft 30 and between the shaft 30 and cut-out sections 18*a* and 18*b*. Alignment pins 24 fit into apertures 20 as the arm main body 12 is mounted on shafts 28, 30 to align and join the arm main body 12 with the arm clamp 14. The pins 24 align the arm clamp 14 with the arm main body 12 when joined together on the shafts 28 and 30. Of course an inverse alignment pin/aperture alignment arrangement would suffice as well, whereas alignment pins 24 extend from the main body 12 and fit into corresponding apertures 20 of the arm clamp 14. (See FIG. 2A). Threaded bolts 42 are securely fastened into holes 26 and 22 to attach the arm clamp 14 to the arm main body 12 onto shafts 28 and 30.

As seen in FIG. 1, a two-piece operating lever 40 is mounted adjacent the arm main body 12 and arm clamp 14 on the operating shaft 30. As better seen in FIGS. 8–11, the operating lever 40 includes a pivot element 40*a* and a base element 40*b*. The pivot element has a pivot hole 40*c* and a semi-circular cut-out section 40*d* therein. Two bolt holes 46 extend into the pivot element 40*a*, one hole extending on each side of the semi-circular cut-out section 40*d*. The base element 40*b* has a corresponding semi-circular cut-out section 40*e* and two bolt holes 48 therein. Two bolts are secured through holes 48 and into holes 46 to attach the pivot element 40*a* to the base element 40*b*, and securely mount the operating lever 40 to the operating shaft 30.

As seen in FIG. 1, a gripper jaw 32 is pivotally mounted to the gripper portion 12*a* of the arm main body 12. The gripper jaw includes a pivot hole (not shown) a catch 32*a* and an operating rod hole 32*b*. A spring element 36 is attached at one end to a peg 12*b* extending from the arm main body 12 and attached at its other end to catch 32*a* causing the gripper jaw 32 to bias toward a closed position.

The operating arm 38 extends from the operating lever 40 to the gripper jaw 32. One end of the operating arm hooks into hole 40*c* of the operating lever while the other end of the operating rod 38 hooks into rod hole 32*b* of the gripper jaw 32.

As seen in FIG. 1, when the operating shaft 30 rotates in a counter clock-wise direction the operating rod 38 is pulled upwardly causing the attached gripper jaw 32 to pivot about pin 34 thereby closing the gripper jaw 32 onto gripper portion 12*a*. This is the gripping action utilized to grip items in the machine. Swing shaft 28 rotates to swing the entire gripper arm assembly and gripped item from one location to another location.

To remove the two-piece gripper arm body 12 and 14 from the shafts 28 and 30, simply remove the bolts 26 and unclip the operating rod 38 from the gripper jaw 32.

To remove the operating lever 40 from the operating lever shaft 30, simply remove bolts 42.

What is claimed is:

1. Amended. A gripper arm body for mounting on a rotatable swing shaft and a rotatable operating lever shaft of a machine used for gripping items and moving said items from one location to another location, the gripper arm body comprising:

an arm body having two semi-circular cut-out sections having opening mouths as an integral part thereof with said opening mouths being in the same plane as said arm body and with a solid portion extending therebetween;

an arm clamp having two corresponding cut-out sections having opening mouths as an integral part thereof and a second solid portion in the same plane as said arm clamp extending therebetween said arm clamp cut-out sections opening mouths being in the same plane as said arm clamp and cooperating with said arm body cut-out sections and said second solid portion cooperating with said first solid portion to create channels to receive said shafts in gripping fashion for mounting the arm body and said arm clamp on said shafts and for gripping said shafts for withstanding operational and rotational loads;

said arm clamp being rigidly attached to said arm main body;

wherein said cut-out sections receiving at least one of said shafts include a one piece split nylon bushing.

* * * * *